US008829380B2

(12) United States Patent
Haeberlin et al.

(10) Patent No.: US 8,829,380 B2
(45) Date of Patent: Sep. 9, 2014

(54) ARC CHUTE, CIRCUIT BREAKER FOR A MEDIUM VOLTAGE CIRCUIT, AND USE OF A POLYMER PLATE

(75) Inventors: Philippe Haeberlin, Troinex-GE (CH); Philippe Noisette, Sergy (FR); Yoann Alphand, Fegersheim (FR)

(73) Assignee: ABB Technology AG, Zürich (CH)

( * ) Notice: Subject to any disclaimer, the term of this patent is extended or adjusted under 35 U.S.C. 154(b) by 517 days.

(21) Appl. No.: 13/149,451

(22) Filed: May 31, 2011

(65) Prior Publication Data

US 2011/0290761 A1 Dec. 1, 2011

(30) Foreign Application Priority Data

Jun. 1, 2010 (EP) ..... 10164561

(51) Int. Cl.

| | |
|---|---|
| ***H01H 9/30*** | (2006.01) |
| ***H01H 9/34*** | (2006.01) |
| ***H01H 9/36*** | (2006.01) |
| *H01H 9/46* | (2006.01) |
| *H01H 73/18* | (2006.01) |

(52) U.S. Cl.

CPC ..... *H01H 9/345* (2013.01); *H01H 9/46* (2013.01); *H01H 73/18* (2013.01); *H01H 9/362* (2013.01)

USPC ..... 218/149; 218/34

(58) Field of Classification Search

CPC ..... H01H 33/04; H01H 33/02; H01H 33/18; H01H 33/20; H01H 9/30; H01H 9/36; H01H 9/362; H01H 9/345; H01H 9/44

USPC ..... 218/15, 34–41, 147–151, 156–158; 335/201, 202

See application file for complete search history.

(56) References Cited

U.S. PATENT DOCUMENTS

| | | | | |
|---|---|---|---|---|
| 4,866,226 | A * | 9/1989 | Hisatsune et al. | 218/37 |
| 6,194,984 | B1 * | 2/2001 | Kappel et al. | 218/152 |
| 2010/0059481 | A1 | 3/2010 | Krätzschmar | |

FOREIGN PATENT DOCUMENTS

| | | | |
|---|---|---|---|
| DE | 36 30 447 | A1 | 3/1988 |
| EP | 1 313 121 | A1 | 5/2003 |
| JP | 2000-208022 | A | 7/2000 |
| WO | WO 2008/087136 | A1 | 7/2008 |

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

The disclosure relates to an arc chute for a medium voltage circuit breaker having a housing, at least one stack of a plurality of substantially parallel metal plates arranged in the housing, the at least one stack defining a first axis in parallel to a stacking direction; an arc space arranged in the housing, wherein the arc space is adapted to allow an arc to expand therein; and at least one arc quenching plate disposed in the housing, wherein the arc guiding plate has at least one surface which has a surface plane extending in parallel to the first axis. Further, the present disclosure relates to a circuit breaker having a switching unit with a first switch contact and a second switch contact, movable between a first position, wherein the first switch contact contacts the second switch contact, and a second position, wherein the first switch contact is separated from the second switch contact, and an arc chute. Additionally, the disclosure relates to a polymer plate selected of a group containing a flame retardant polymer, a flame retardant polymer having a flame retardant filler, and a polymer having a flame retardant filler as an arc quenching plate.

18 Claims, 4 Drawing Sheets

ARC CHUTE, CIRCUIT BREAKER FOR A MEDIUM VOLTAGE CIRCUIT, AND USE OF A POLYMER PLATE

The present invention relates to an arc chute for a medium voltage circuit breaker. Further, the present invention relates to a circuit breaker for a medium voltage circuit. More specifically, the present invention relates to an arc chute for a medium voltage direct current circuit breaker and to a circuit breaker for a direct current medium voltage circuit. Typically, medium voltage is a voltage between 400 V and 4000 Volt. Further, the present invention relates to a use of a polymer plate.

Typically, circuit breakers or air circuit breakers are used in a direct current (DC) circuit on railway vehicles. Other examples may be tramways or trolley buses. For example, such high speed DC circuit breakers may switch direct currents of 1.5 kA with a voltage level of more than 900 Volt.

For example, when disconnecting a first switch contact from a second switch contact, gases between the switch contacts quickly become conductive because of air ionisation and a plasma may appear. Further, a back re-ignition or re-strike phenomena may happen, especially at high currents, for example for currents greater than 40 kA. Thus, the circuit breaker capability may be decreased. Further, at a certain current level, the arc between the first contact and the second switch contact does not even climb inside the arc chute. Further, the wear, in particular at high currents may be important. Additionally, conventional arc chutes are heavy and high.

In arc chute assemblies of conventional DC-circuit breakers plastic frames and metal plates are alternatingly stacked upon each other, wherein the metal plates are disposed on the plastic frames. The plastic frames form dielectric layers between the metal plates. The plastic frames have a cut out such that an arc may be built up between two adjacent metal plates. The plastic frames are used to generate gas, such that the heat in the arc is quickly blown out of the arc chute and to increase the arc voltage by a change of the chemical composition of the air between the metal plates.

Typically, the arc often moves on the metal plates, usually within the cut out. However, often the arc stays at a corner of the cut out. Thus, the metal of the metal plates gets very hot at these corners and may start melting. In the worst cases, adjacent metal plates are connected to each other by melted metal.

This leads to a short lifetime of the arc chutes and a big structural dimension due to an increased distance between the metal plates to avoid a connection between two adjacent metal plates due to melted metal, and an increased number of the metal plates and plastic frames.

Typically, conventional arc chutes are heavy and have a high height. Further, the wear is important, in particular at high currents, for example at currents greater than 1 kA. Typically, the wear depends on the number of operations, the current density and the arcing time (time constant). Thus, the wear of the arc chute is not predictable. Hence, maintenance operations are difficult to plan but are nevertheless indispensable. For example, the metal or steel plates may be often checked and replaced. Further, the plastic frames may be checked as well and sometimes even replaced. Further, there is a risk of steel drop minimum between the plates, such that less voltage is built up. In the worst case, the circuit breaker may not able to cut the next time. Further, typically more than 120 components have to be assembled and the clearance distance is increased.

Object of the invention is to provide an arc chute for a medium voltage circuit breaker, a circuit breaker and a use of a polymer plate, such that a circuit breaker using such devices do not present the drawbacks of the known circuit breakers, in particular has an increased breaking capability and is easier to maintain.

According to a further aspect, an arc chute for a medium voltage circuit breaker is provided comprising a housing, at least one stack of a plurality of substantially parallel metal plates arranged in the housing, the at least one stack defining a first axis in parallel to a stacking direction; an arc space arranged in the housing, wherein the arc space is adapted to allow an arc to expand therein; and at least one arc quenching plate disposed in the housing, wherein the arc quenching plate has at least one surface having a surface plane extending in parallel to the first axis.

In an embodiment, the arc chute may be also used for alternate current (AC) applications.

In a typical embodiment, the at least one arc quenching plate is guiding the arc in the arc chute. Typically, the at least one arc quenching plate supports a quenching of the arc in the arc chute. For example, in an embodiment, a gas evaporates from the at least one arc quenching plate, when an arc passes by and the at least one arc quenching plates are heated.

In a typical embodiment, the at least one surface of the at least arc quenching plate may be structures, for example, the at least one surface may comprise a profile and/or may be corrugated. Then, typically, the surface plane of the surface is defined as a plane on the surface being parallel to the mid-surface of the arc quenching plate. In a typical embodiment, the aspect ratio of the surface of the arc quenching plate is between 1/15 and 1/3, in particular between 1/10 and 1/5.

In a typical embodiment, the at least one arc quenching plate has an extension in direction of the first axis of at least 50%, in particular at least 80%, of the extension of the at least one stack of metal plates in direction of the first axis.

For example, in an embodiment, a second axis traverses in parallel to the metal plates, i.e. parallel to the surfaces of the metal plates, the at least one stack and the arc space substantially orthogonal to the first axis, wherein the surface plane of the at least one surface of the arc quenching plate is extending parallel to the second axis. In embodiments, the second axis traversing parallel to the surface of the metal plates the at least one stack and the arc space may have an angle to the first axis of between 80 and 100 degrees, in particular between 85 and 95 degrees. Typically the surface plane of the at least one surface of the arc quenching plate is arranged parallel to a side wall of the housing. Thus, the arc quenching plate may not block gases flowing in an exhaust direction, for example an opening in the housing of the arc chute.

In a typical embodiment, which may be combined with other embodiments disclosed herein, the at least one arc quenching plate may comprise a plurality of sub-plates, which may be arranged to form the at least one arc quenching plate. For example, the arc quenching plate may comprise two sub-plates, each of the sub-plates may have a different content in weight of a flame retardant filler. For example, the two sub-plates may be arranged one after another in direction of the second axis, wherein typically a first sub-plate with the higher content of a flame retardant is disposed with a greater distance to the arc space than a second sub-plate with the lower content of the flame retardant filler. For example, the extension of the first sub-plate in direction of the second axis is between 50% and 80%, in particular 60% to 75%, of the extension of the arc quenching plate. Typically the flame retardant may be aluminiumtrihydrate (ATH).

In a typical embodiment, which may be combined with other embodiments disclosed herein, the arc space is adapted to allow an arc to displace and/or expand along the first axis.

For example, in an embodiment, the at least one arc quenching plate has an extension in direction of the second axis of between about 20% and about 80%, in particular between about 25% and about 60%, of the extension of the metal plates in direction of the second axis. For example, in case of an extension of the metal plates in direction of the second axis of 100 mm, the arc quenching plate may have an extension in direction of the second axis of about 30 mm.

In a typical embodiment, the metal plates of the at least one stack have two longitudinal edges extending in parallel to the second axis, wherein at least one arc quenching plate is arranged between the two longitudinal edges, in particular substantially in the middle between the two longitudinal edges. Typically, the arc is kept in the middle of the metal plates such that the heat distribution of the metal plates is more equal. This may lead to a lower wear of the metal plates.

For example, in an embodiment, the metal plates are substantially rectangular having two transversal edges parallel to a third axis being orthogonal to the first axis and the second axis, and two longitudinal edges parallel to the second axis, wherein the metal plates have respectively a substantially V-shaped or U-shaped cut-out in a first transversal edge adjacent to the arc space, wherein one of the arc quenching plates is disposed between the V-shaped or U-shaped cut-out and the second transversal edge. In a typical embodiment, the V-shaped or U-shaped cut-out may be asymmetrically arranged at the transversal edge.

In a typical embodiment, the second transversal edge has a greater distance to the arc space than the first transversal edge.

For example, in an embodiment, the metal plates of the at least one stack are according to one of the embodiments disclosed herein, wherein one of the arc quenching plates is disposed in the slot.

According to an aspect, a metal plate for a stack of a plurality parallel metal plates of an arc chute, wherein the metal plate is substantially rectangular and has a two longitudinal edges and two transversal edges, wherein the metal plate comprises a slot, wherein the slot extends substantially parallel to the longitudinal edges and has a longitudinal extension of at least 20%, in particular of at least ⅓, of the length of the longitudinal edge. In an embodiment, the slot may have a maximal extension of 80% of the length of the longitudinal edge.

In a typical embodiment, the metal plate is a deionizing plate of an arc chute.

In a typical embodiment, which may be combined with other embodiments disclosed herein, the slot is a straight slot. Typically the slot has a width between 3 mm and 10 mm, in particular between 4 mm and 7 mm.

In an embodiment, the slot is arranged substantially in the middle between the two longitudinal edges and/or extends from a substantially V-shaped or U-shaped cut-out in the transversal edge, wherein the V-shaped or U-shaped cut-out has an extension in longitudinal direction of at least 10%, in particular 15%, of the length of the longitudinal edge.

In a typical embodiment, the slot extends from an intersection point of the substantially V-shaped cut-out, where the two arms of the V-shaped cut-out meet. This is typically the case in case of a symmetric V-shaped cut-out or a V-shaped cut-out disposed symmetrically in the transversal edge.

In a typical embodiment, which may be combined with other embodiments disclosed herein, the arms of the V-shaped cut-out have an angle of between 60 to 120 degrees between each other, in particular substantially between 80 and 100 degrees.

In a typical embodiment, which may be combined with other embodiments disclosed herein, the plate comprises a second straight slot arranged to form with together with the slot extending in parallel to the longitudinal edges a substantially T-shaped, wherein the second slot has an extension parallel to the transversal edges of at least substantially 50%, in particular 70%, of the length of the transversal edge.

Longitudinal edges are longer than the transversal edges, for example the metal plate may have an aspect ratio of between 1:2 and 3:4, in particular about 2:3.

In a typical embodiment, the arc quenching plate is disposed, such that an edge of the arc quenching plate directed to the arc space has a distance to the end of the slot in direction of the arc space and/or to an end of the V-shaped or U-shaped cut-out towards the second transversal edge of at least about 10% of extension of the arc quenching plate in direction of the second axis. According to another embodiment, the edge of the arc quenching plate directed to the arc space has a distance to the end of the V-shaped or U-shaped cut-out towards the second transversal edge of at least about 2% of the length of the longitudinal edge of the metal plate.

For example, in an embodiment, at least one, in particular two, arc quenching plate is delimiting the arc space in a direction orthogonal to the first axis and orthogonal to the second axis.

In a typical embodiment, which may be combined with other embodiments disclosed herein, the at least one arc quenching plate delimiting the arc space is acting as a stop for the metal plates of the at least one stack, such that a movement of the metal plates into the arc space is prevented.

For example, in an embodiment, at least two parallel stacks of metal plates, wherein a second axis traverses the at least two stacks, wherein in particular a respective arc quenching plate is in both stacks.

In a typical embodiment, more than 70%, in particular more than 90%, of a surface of a metal plate of the stack face the surface of an adjacent metal plate of the same stack.

According to a further aspect, a circuit breaker comprising a switching unit having a first switch contact and a second switch contact, movable between a first position, wherein the first switch contact contacts the second switch contact, and a second position, wherein the first switch contact is separated from the second switch contact, and an arc chute according to an embodiment disclosed herein.

In a typical embodiment, which may be combined with other embodiments disclosed herein, the circuit breaker is an air circuit breaker.

For example, in an embodiment, the circuit breaker is a circuit breaker for a traction vehicle, in particular a railway vehicle, a tramway, a trolleybus and the like.

In a typical embodiment, the arc displacement direction parallel is to first axis and/or the moving direction of the second switch contact, when moving from the first position to the second position, is parallel to the second axis.

In a typical embodiment, the circuit breaker is an air direct current (DC) circuit breaker. Thus, each current interruption generates an arc. Typically, an arc starts from a contact separation and remains until the current is zero. In typical embodiments, to be able to cut out DC currents high speed DC circuit breakers build up direct current (DC) voltages that are higher than the net voltage. To build up a DC voltage, air circuit breakers use an arc chute or extinguish chamber in which metallic plates are used to split arcs into several partial arcs, the arc is lengthened and gases are used to increase the arc voltage by a chemical effect, for example by evaporation of plastic or another material.

In a typical embodiment, the circuit breaker may switch direct currents with more than 400 Volt and/or with more than 500 Ampere. In some embodiments, the circuit breaker may have a rated short circuit breaking capacity of more than 20 kA for 50 milliseconds, in particular more than 30 kA.

In a typical embodiment, the material of the arc quenching plates or guides may increase, according to a theory, in a vaporized state the air resistance between the metal plates of the arc chute. Further, the arc quenching guides may generate the right gases, at the right place at the right pressure. For example, the dielectric properties are increased during arcing. Typically, temperatures of more than 20000° C. are generated during breaking.

Typically, the arc quenching plates or guides may guide the arc up to the top of the arc chute.

Further, the arc quenching plates or guides may facilitate the introduction of fresh air into the arc chute.

According to a further aspect, a use of a polymer plate is provided selected of the group consisting of a flame retardant polymer, a flame retardant polymer comprising a flame retardant filler, and polymer comprising a flame retardant filler as an arc quenching plate in an arc chute according to an embodiment disclosed herein.

Typically, in an arc-chute comprising an arc quenching plate or guide the breaking capabilities are increased and the risk of re-strike is avoided. In particular, the space between the plates without risk of short circuit between them is reduced. Further, the plates and/or the arc-chute have almost no wear. Thus, maintenance is easy to plan. Further, the arc-chute is quick assembly and easily scalable. Hence, the arc-chute comprising the arc quenching plates or guides can be cheaply produced.

In a typical embodiment, the positioning device is a screw, a hinge, a bolt, a stop, a bar, and the like. For example, the positioning device is used to connect the arc chute to the switching unit.

In a typical embodiment, which may be combined with other embodiments disclosed herein, the circuit breaker is a circuit breaker for a traction vehicle, in particular a railway vehicle, a tramway, a trolleybus and the like.

In a typical embodiment, an arc-chute housing having at least one side wall, said at least one side wall being substantially parallel to the second axis, wherein the distance between the at least one sidewall and the metal plates is less than 10 mm, in particular less than 5 mm. For example, the distance may be less than 2 mm. In a typical embodiment, which may be combined with other embodiments disclosed herein, the at least one side wall contacts the metal plates.

In a typical embodiment, the at least one side wall has a dimension in direction of the second axis, such that the side wall covers completely at least the at least one stack and the arc space. For example in case of two stacks, the side wall covers the two stacks and the arc space between the two stacks. In a typical embodiment, the at least one side wall has a dimension in direction of the second axis corresponding at least 110%, in particular at least 120% of the dimension of the at least one stack, in particular of the two stacks, and the arc space in direction of the second direction.

Typically, the side wall has a height in direction of the stacking direction corresponding at least to the dimension of the stack in direction of the first axis.

In a typical embodiment, which may be combined with other embodiments disclosed herein, the side wall is substantially closed.

In a typical embodiment, which may be combined with other embodiments disclosed herein, the housing of the arc chute has openings in direction of the second axis.

In a typical embodiment, which may be combined with other embodiments disclosed herein, the opening has dimension in direction of the first axis of at least 90%, in particular 95%, of the at least one stack.

In a typical embodiment, the opening has a dimension corresponding substantially to the dimension of the metal plates in a direction orthogonal to the first axis and the second axis, for example at least 90%, in particular at least 95% of the width of the metal plates. Typically the width of the metal plates is measured along a third axis orthogonal to the first axis and orthogonal to the second axis.

In a typical embodiment, wherein the metal plates are substantially rectangular, having a first edge in the direction of the arc space, and a second edge opposite to the first edge, and in particular two side edges substantially parallel to the second axis, wherein the opening of the arc chute housing is adjacent to and/or on the side of the second edge of the metal plates.

So that the manner in which the above recited features of the present invention can be understood in detail, a particular description of the invention, briefly summarized above, may be discussed with reference to embodiments. The accompanying drawings relate to embodiments of the invention and are described in the following:

Reference will now be made in detail to the various embodiments, one or more examples of which are illustrated in the figures. Each example is provided by way of explanation, and is not meant as a limitation of the invention. Within the following description of the drawings, the same reference numbers refer to the same components. Generally, only the differences with respect to individual embodiments are described.

Figure 1:
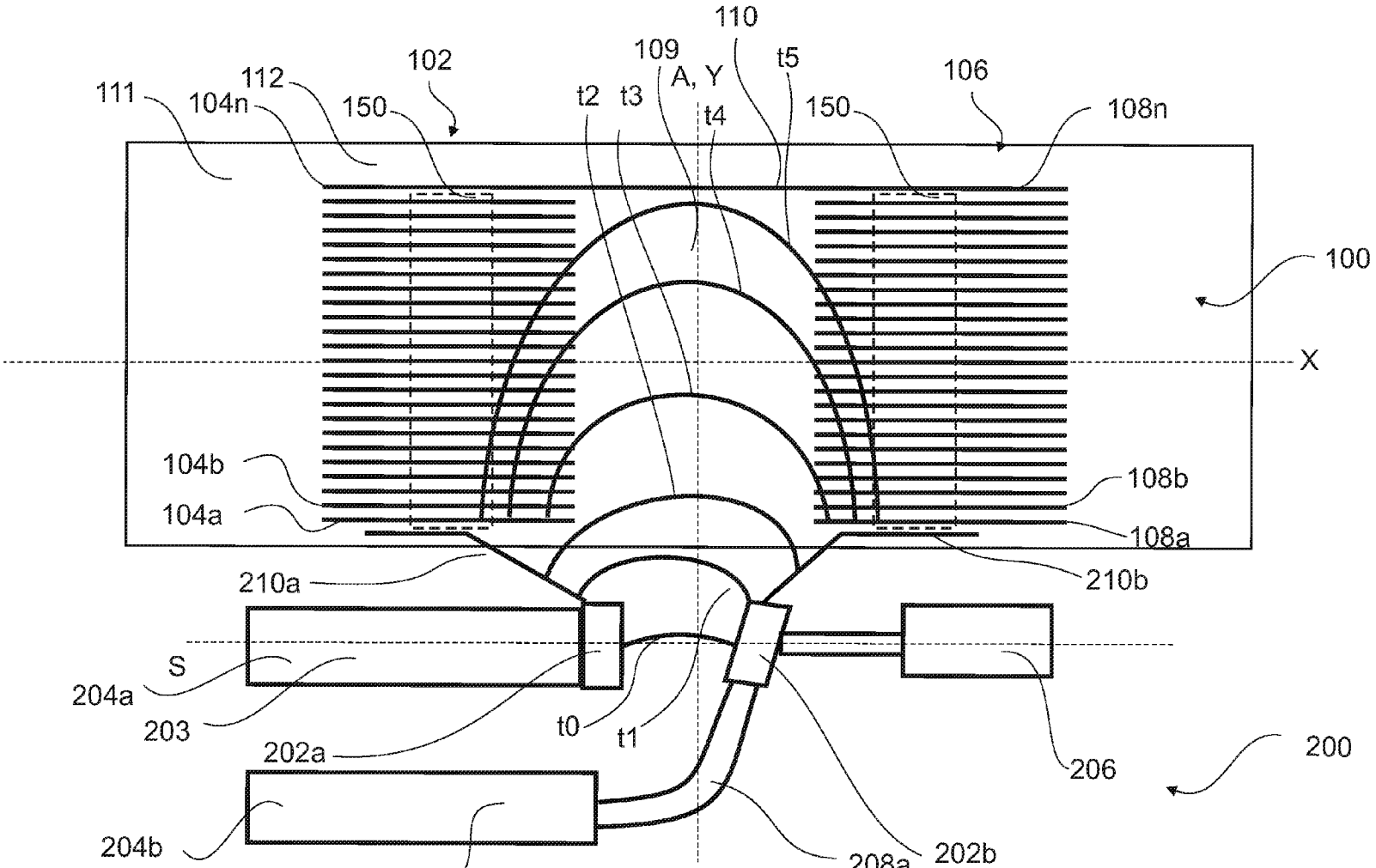
FIG. 1 shows schematically a side view of an embodiment of a circuit breaker with open switch contacts.

FIG. 1 shows a side view of a high speed medium voltage direct current (DC) circuit breaker. The circuit breaker is typically an air circuit breaker. The circuit breaker includes an arc chute 100 and a switch unit 200. The arc chute includes a first stack 102 of metal plates 104*a*, 104*b*, . . . , 104*n* and in an embodiment, which may be combined with other embodiments disclosed herein a second stack 106 of metal plates 108*a*, 108*b*, . . . , 108*n*.

In a typical embodiment, the number and the form of the metal plates 104*a*, 104*b*, . . . , 104*n*, 108*a*, 108*b*, . . . , 108*n* of the first and the second stack 102, 106 are substantially equal. An arc space 109 is disposed between the first stack 102 and the second stack 106 of metal plates.

Typically, when the circuit breaker is opened, an arc mounts in the arc space 109 in an arc displacement direction A.

Typically, the arc chute is symmetric to a first axis Y, typically corresponding to the arc displacement direction A, traversing the arc space 109 which is parallel to the stacking direction of first stack 102 of metal plates and the second stack 106 of metal plates. Further, in a typical embodiment, the top level metal plate 104*n* of the first stack 102 is electrically connected to the top level metal plate 108*n* of the second stack 106 with a connection bar 110. Thus, the top level metal plate 104*n* of the first stack is on the same electrical potential as the top level metal plate 108*n* of the second stack 106.

The lowest metal plate or level zero metal plate 104*a* of the first stack 102 and the lowest metal plate or level zero metal plate 108*a* are typically the closest metal plates of the respective stacks 102, 106 with respect to the switch unit 200. Hence, the lowest metal plates 104*a*, 108*a* and the top level plates 104*n*, 108*n* are disposed on opposite ends in stacking direction, which is typically parallel to the arc displacement direction A or the first axis Y of the arc chute, of the respective stack 102, 106 of metal plates.

Typically, the surfaces of metal plates or deionising plates 104, 108 of the first stack 102 and the second stack 106 are parallel to a second axis X, which is typically orthogonal to the arc displacement direction A and the first axis Y.

In a typical embodiment, each stack 102, 106 includes about 36 metal plates 104*a*, 104*b*, . . . 104*n*, 108*a*, 108*b*, . . . 108*n*. Other embodiments may event include more than 36 metal plates. The number of metal plates typically depends on the nominal current that is switched by the circuit breaker.

In a typical embodiment, the arc chute 100 comprises a housing 111 having at least one side wall 112. In a typical embodiment, the arc chute 100 with its housing may be easily separated from the switch unit 200. Thus, the maintenance time may be reduced. For example, a positioning device is used to arrange the arc chute at the correct position on the switch unit. The positioning device may be a stop, a screw, or another device to provide the arc chute 100 at the correct position on the switch unit 200.

The switch unit 200 includes a first switch contact 202*a*, which may be electrically connected to an electric network or a load by a first switch contact terminal 204*a*. Typically, the first switch contact is connected with a first switch contact bar or bus bar 203 to the first switch contact terminal 204*a*, wherein in particular the first switch contact bar 203 includes the first switch contact terminal 204*a*. Typically, the first switch contact 202*a* is fixed to a first end of the first switch contact bar 203, and the first switch contact terminal 204 is disposed at a second end of the first switch contact bar 203, opposite to the first end.

Further, the switch unit 200 includes a second switch contact 202*b*. The second switch unit is moved by a driving unit 206 in a moving direction S, to move the second switch contact 202*b* from a first position in which the first switch contact 202*a* is in physical contact with the second switch contact 202*b*, and a second position in which the first switch contact 202*a* is separated from the second switch contact 202*b*. The second position is shown in FIG. 1. The second switch contact 202*b* may be connected via a second switch contact terminal 204*b* to an electrical network or the load. The second switch contact 202*b* is electrically connected to the second switch contact terminal 204*b* by a flexible conductor 208*a* and a second switch contact bar 208*b*, wherein the flexible conductor 208*a* is connected to a first end of the second switch contact bar 208*b*. Typically, the second switch contact terminal 204*b* is disposed at a second end of the second switch contact bar 208*b*, wherein the second end is opposite to the first end of the second switch contact bar 208*b*.

Typically, the arc space 109 is disposed above the first and second switch contact in operation of the circuit breaker, when the circuit breaker is in closed position, i.e. the first switch contact 202*a* contacts the second switch contact 202*b*. Further, the stacking direction of the stack of metal plates 102, 106 is substantially parallel to an arc displacement direction A, which is substantially orthogonal to the moving direction S. Typically, the stacking direction or arc displacement direction A corresponds to a direction in which the arc extends into the arc chute. Typically, the metal plates 104*a*, 104*b*, . . . , 104*n*, 108*a*, 108*b*, . . . , 108*n* and the connection bar 110 are substantially parallel to the moving direction S, and thus to the second axis X.

A first horn 210*a* is fixed to the first contact 202*a* to guide a foot of an arc to the metal plates 104*a*, 104*b*, . . . 104*n*, in particular to the lowest metal plate 104*a*, of the first stack 102 of the arc chute 100. Further, the switch unit 200 is provided with the second horn 210*b* which is disposed, such that the arc having foot at the second switch contact 202*b* jumps to the horn 210*b* and moves to the metal plates 108*a*, 108*b*, . . . , 108*n*, in particular to the lowest metal plate 108*a*, of the second stack 106.

In a typical embodiment, the lowest metal plate 104*a* of the first stack 102 and the lowest metal plate 108*a* of the second stack 106 are respectively electrically connected to the first switch contact 202*a* and the second switch contact 202*b*. Thus, an arc foot of an arc created by interrupting a current typically do not remain on the first and second horns 210*a*, 210*b* and jump on the lowest metal plates 104*a*, 108*a*. Once, the respective arc foot has jumped to the lowest metal plates, current flows through a respective equipotential connection. Typically, the horns are not heated up by the arcs and thus do not evaporate. Further, the horn wear out is reduced such that the horns, for example the first horn 210*a*, and a second horn 210*b* may withstand the life time of the circuit breaker. Typically, the heat dissipation is increased once the arc has jumped onto the lowest metal plates. Further, less gas is generated close to the switch contacts. Typically, a heat concentration close to the switch contacts is reduced, such that the risk of a plasma generation and recognition phenomenal is reduced.

FIG. 1 shows a side view of the circuit breaker in the open state, wherein the first switch contact 202*a* is separated from the second switch contact 202*b*. Further FIG. 1 shows schematically an arc expansion within the arc chute 200, in particular, the arcs at different moments after the opening of the switch by moving the second switch contact 202*b* away from the first switch contact 202*a*.

At a first time, t0, after the contact separation of the first switch contact 202*a* and the second switch contact 202*b* the arcing starts.

Then, at t1, the arc, or one foot of the arc, leaves one of the first or second switch contacts 202*a*, 202*b*, and jumps to the horn 210*a*, 210*b* of the respective switch contact 202*a*, 202*b*. This may either happen first on the fixed, i.e. the first switch contact 202*a*, or on the moving contact, i.e. the second switch contact 202*b*. At t2, the arc leaves the second switch contact. Then, the arc feet are located on first horn 210*a* and the second horn 210*b* respectively.

Then, at t3 the arc feet jump on the respective level zero or lowest metal plates 104*a*, 108*a* and the arc continues to climb within the arc chute. Typically, at this stage, several little arcs are generated between respective adjacent metal plates of the first and second stack 102, 104.

At t4 the arc is well established on the lowest metal plates 104*a*, 108*a* of the first and second stack 102, 106 respectively and continues to climb within the arc chute, in particular the arc space 109. Finally, at t5 the arc is fully elongated having reached the top of the arc chute, so that the maximum voltage is built. The voltage built up by the arc starts at t0, increases from t1 to t4, and reaches its maximum value approximately at t5. Typically, the sequence is for example influenced by the magnetic field generated by the current, for example for currents greater than 100 A, a chimney effect due to hot gases, for example for currents lower than 100 A, and/or the mechanical behaviour of the circuit breaker, for example the velocity of the second switch contact 202*b*.

In a typical embodiment, the arc remains present until the current is zero, then the arc is naturally extinguished. Typically, the arcing time is proportional to the prospective short circuit current in time constant of the circuit, the current level when opening, the required voltage to be built up for cutting the contact velocity, for example of the second switch contact, the geometrical circuit breaker design, for example the chimney effect, and/or the material used which has influence on the gas created in the arc chute or the circuit breaker.

In a typical embodiment, the arc chute is disposed on the switch unit such that the arc space is above the first and second switch contacts, when the switch contacts are contacting each other.

Figure 2:
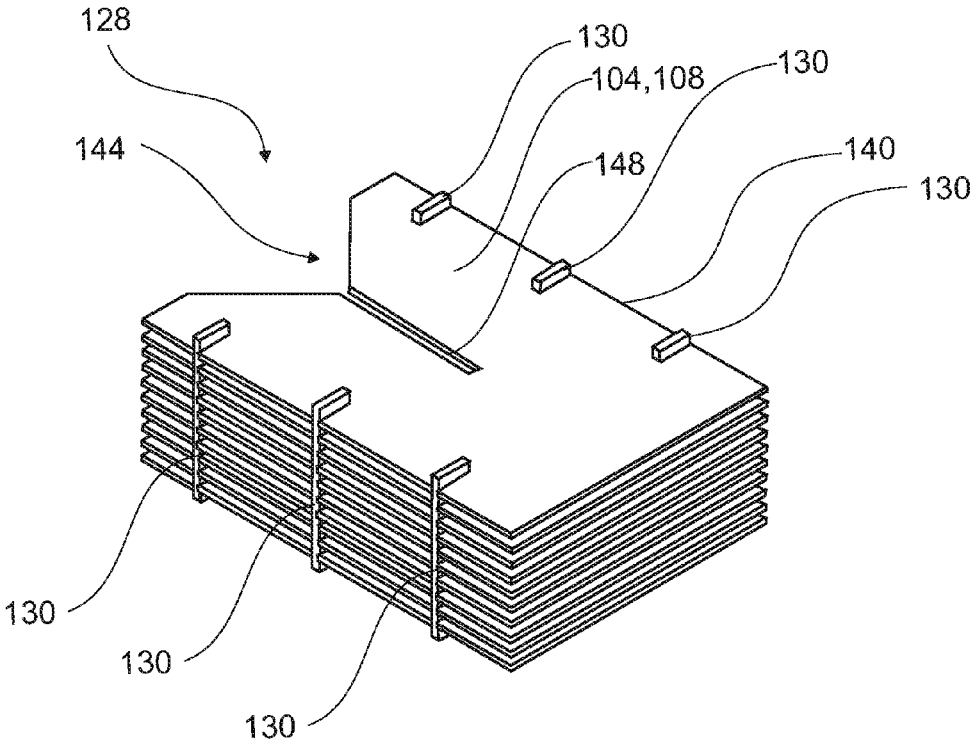
FIG. 2 shows schematically a group of metal plates.

FIG. 2 shows a group 128 of metal plates 104, 108 for the first stack 102 or for the second stack 106. In a typical embodiment, which may be combined with other embodiments disclosed herein, the group of metal plates 128 being connected or grouped by a plurality of comp like support devices 130. For example, the group of metal plates 128 for the arc chute may include five to twenty metal plates, in particular ten metal plates.

Figure 3:
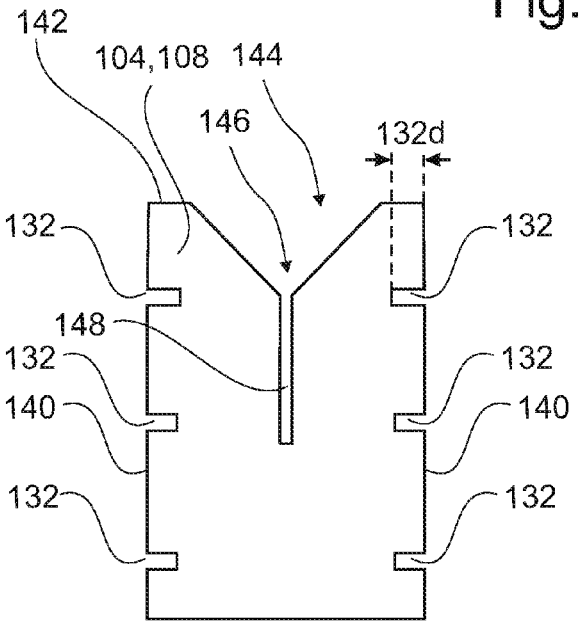
FIG. 3 shows schematically an embodiment of a metal plate of a stack.

A schematical top view of a typical embodiment of a single metal plate 104, 106 is shown in FIG. 3. Each metal plate 104, 106 includes a plurality of cut outs 132 for the support device 130, for example six cut outs as shown in FIG. 3. Typically, the cut outs 132 have a depth 132*d*. Also another number of cut outs may be provided in the metal plates, for example four cut outs. The cut outs 132 are adapted for the comb like support device 130. In a typical embodiment, the cut outs 132 are substantially rectangular, so that the support device may be slidingly introduced into the cut-outs 132.

Typically, the metal plates have a thickness of about 0.5 mm to about 8 mm, in particular between 1 mm and about 3 mm, for example about 1 mm. In a typical embodiment, which may be combined with other embodiments disclosed herein, the metal plates 104, 108 may have a surface of about 3000 $mm^2$ to 12000 $mm^2$, in particular between about 5000 $mm^2$ and about 8000 $mm^2$. In a typical embodiment, the volume of the metal plates is between about 3000 $mm^3$ and about 20000 $mm^3$, in particular between about 5000 $mm^3$ and about 10000 $mm^3$. For example a single metal plate or steel plate may have a weight between 30 and 100 g, for example about 50 g.

Further, the metal plates of the arc-chute have two parallel longitudinal edges 140 and two transversal edges 142 orthogonal to the longitudinal edges 140. Typically, the longitudinal edges 140 are longer than the transversal edges 142. For example, the aspect ratio between the transversal edges 142 and the longitudinal edges may be 2:3. In other embodiments the aspect ratio may be between 1:2 and 4:5. The metal plates are arranged in the arc-chute, such that the longitudinal edges 140 are substantially parallel to the moving direction S of the second switch contact of the switch unit 200, onto which the arc-chute will be connected.

In a typical embodiment, the metal plates are substantially rectangular having a substantial V-shaped cut-out 144 at the transversal edges 142, in particular to be disposed adjacent to the arc space 109. Typically, the cut out corresponds to more than 50 percent, for example between 60 and 90%, of the transversal edge 142 including the cut-out. In a typical embodiment, the cut out has an extension in longitudinal direction of at least 10%, in particular 15%, of the length of the longitudinal edge The substantial V-shaped cut-out 144 has two arms or legs enclosing an angle between substantially 60 and 120 degrees. In other embodiments, the metal plates may comprise a U-shaped cut-out or cut outs with a similar shape.

In direction of the centre of the metal plate 104, 108, the substantial V-shaped cut-out has a bottom 146 at a position where the two arms would intersect. From a bottom 146 of the V-shaped cut-out 144 a straight slot 148 extends parallel to the longitudinal edges 140. Thus, the straight slot 148 extends the substantial V-shaped cut-out 144. Typically, the slot 148 has a length of substantially at least 20% of the length of the longitudinal edges 140, for example between 30% and 80% of the length of the longitudinal edge 140. The width of the straight slot parallel to the transversal edge 142 is between about 3 mm and about 10 mm, in particular between 4 mm and about 7 mm.

Figure 4:
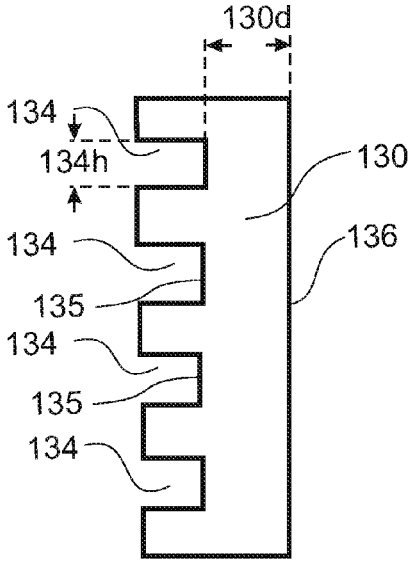
FIG. 4 shows schematically a side view of a support device.

In a typical embodiment, which may be combined with other embodiments disclosed herein, the distance between the metal plates in an arc chute is about 1 to about 8 mm, in particular 2 to about 4 mm, in particular in direction of the first axis or the arc displacement direction FIG. 4 shows a schematical side view of an embodiment of a support device 130. The comp like support device 130 has a plurality of support cut outs 134, typically regularly spaced. The support cut outs 134 are provided on a side first to be introduced in the cut outs 132 of the metal plates 104, 108. In a typical embodiment, the support cut outs 134 may have height 134*h* corresponding to the thickness of the metal plates 104, 108. Thus, with a plurality of comp like support devices 130, a plurality of the metal plates 104, 108 may be grouped. Typically the support device may be fabricated from a plastic material.

Further, in an embodiment, which may be combined with other embodiments disclosed herein, the remaining thickness 130*d* of the support device between a bottom 135 of the support cut outs 134 and a rearward edge 136 of the support device 130 opposite to the support cut outs 134 corresponds substantially to the depth 132 of the cut out in the metal plates. Thus, when the comb like support device 130 is inserted in the cut outs 132 of the metal plates, the rearward edge 136 opposite to the support cut outs 134 is not projecting from the circumference of the metal plates 104, 108. Hence, a sidewall of the housing may contact the metal plates of the arc chute.

Typically, more than 70%, in particular more than 90%, of a surface of a metal plate of a stack face the surface of an adjacent metal plate. That means that the space between adjacent metal plates is substantially free, in particular from a plastic frame or other material that may impede a creation of an arc between the respective adjacent metal plates. In a typical embodiment, which may be combined with other embodiments disclosed herein, more than 95% of the surface of a metal plate of the stack faces the surface of an adjacent metal plate. Typically, the arc between adjacent metal plates of a stack 102, 106 may not stay at the same place on the surface of a metal plate. They may use the complete space to move around on the surface of the metal plate of an arc chute. Thus, the wear of the metal plates is more uniform, such that the distance and the thickness of the plates may be reduced. Further, also the cooling of the metal plates is improved.

Figure 5:
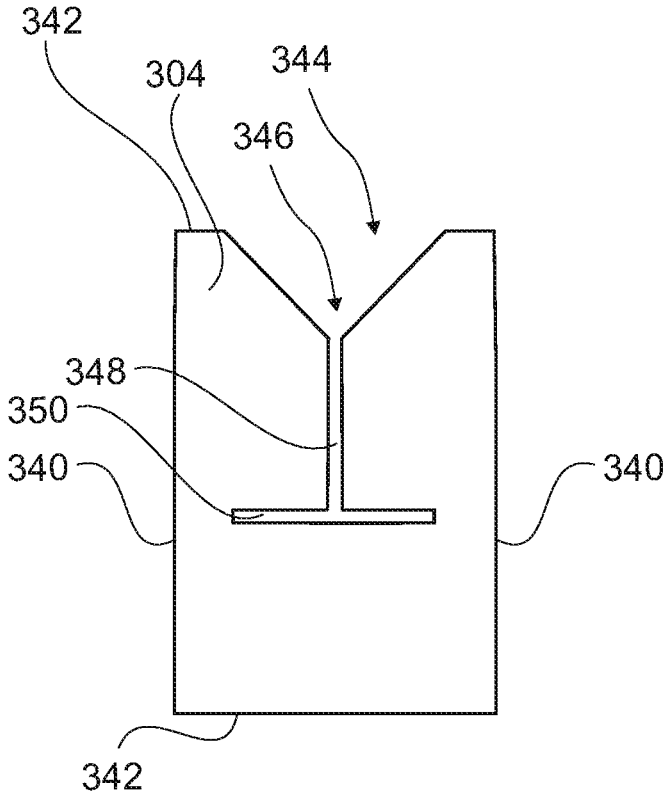
FIG. 5 shows schematically an embodiment of a metal plate of a stack.

FIG. 5 discloses a further embodiment of a metal plate 304 for a stack of an arc-chute. The metal plate may used as a metal plate 104 of the first stack 102 and/or as a metal plate 108 of the second stack 106 shown in FIG. 1. The metal plate 304 is formed similarly to the plate shown in FIG. 3. Thus, the reference signs of FIG. 5 correspond to the reference signs of FIG. 3 with an addition of 200. Two substantially straight slots are disposed in the plate 304, namely a first slot 348 and a second slot 350, that are disposed, so that the first slot 348 and the second slot 350 form a T. Thus, the first slot 348 has a first end disposed at the bottom of the substantially V-shaped cut-out 344 and a second end connected to the second slot 350. The second slot 350 extends substantially parallel to the transversal edges 342 and thus orthogonal to the longitudinal edges 340. The first slot 348 has substantially a length of about 20% to 80%, in particular between 30% and 60% of the length of the longitudinal edges. Typically, the second straight slot has a length of at least 40% of the length of the transversal edge 342, in particular at least 60%.

Figure 6:
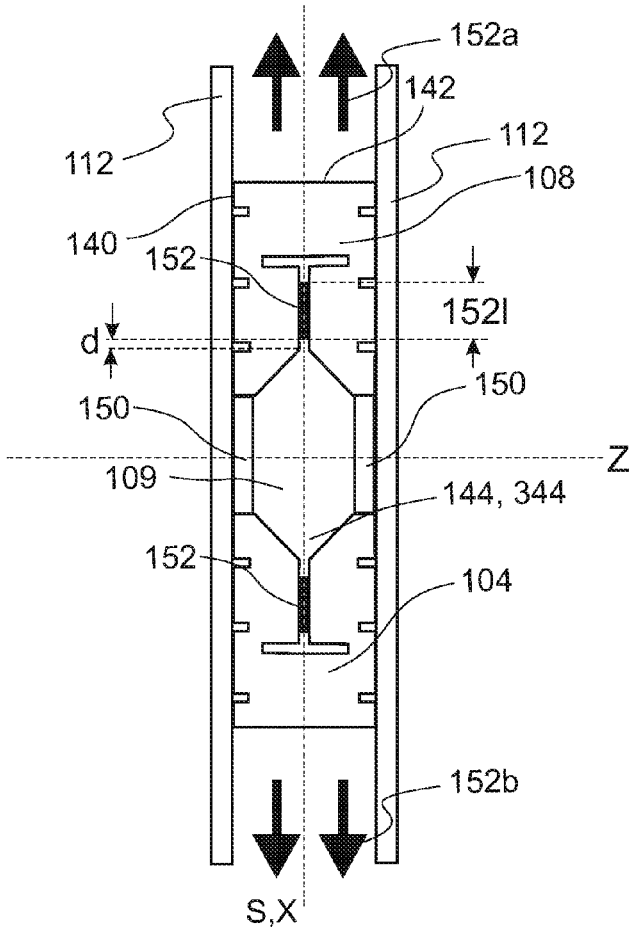
FIG. 6 shows schematically a section of an arc chute in a top view.

FIG. 6 shows a top view of a horizontal section of an embodiment of the arc chute 100. The arc chute 100 includes a housing 111 having sidewalls 112. In a typical embodiment, the sidewalls 112 are manufactured from a plastic plate. For example, the sidewalls are substantially closed. The side wall 112 is disposed typically in a plane parallel to a plane spanned by the moving direction S and the stacking direction A.

In an embodiment, first arc quenching plates or arc quenching guides 150 is arranged at the sidewall 112 in the arc space 109, in particular at each sidewall 112 between the metal plates 104, 108 of the first stack 102 and the second stack 106, so that an arc can ascent within the arc chute 100 between the first stack 102 and the second stack 106. In a typical embodiment, which may be combined with other embodiments disclosed herein, the arc quenching plates are fixed to the side walls 112. In a typical embodiment, the blocks 128 of metal plates are inserted from the top into the arc chute 100. Further, the first internal arc quenching plates 150 limit the arc space 109 in a direction of a third axis Z orthogonal to the arc displacement direction A and orthogonal to the moving direction S or the second axis X. Thus, the surface of the arc quenching plate in direction of the arc space is substantially parallel to a plane orthogonal to the axis Z. In a further embodiment, stops are provided to stop a movement of the metal plates 104, 106 of the first stack 102 or the second stack 106 towards the arc space 109, in particular along the second axis X. For example, the extension of the first arc quenching plates corresponds substantially to the distance between the metal plates 104 of the first stack 102 and the metal plates 108 of the second stack 106. The first arc quenching plates may have a thickness of between 1 and 10 mm, in particular between 2 and 4 mm.

In an embodiment, the first arc quenching plates 150 are then disposed adjacent to the side walls 112 to guide the arc in the arc space 109.

Typically, the first arc quenching plates 150 extend in arc displacement direction substantially all along the metal plates 104, 108 of the stacks 102, 106 of the arc chute 100. For example, the first arc quenching plates 150 may cover or have a length in arc displacement direction substantially of at least 50%, in particular at least 80%, of the arc space 109.

Further, in a typical embodiment, which may be combined with other embodiments disclosed herein, second arc quenching plates are disposed in the (first) straight slots 148, 348 of the metal plates. The second arc quenching plates 152 are substantially plate shaped and oriented, such that the surfaces of the second arc quenching plates 152 are substantially parallel to the sidewalls 112 of the arc-chute. Typically, the surfaces of the second arc quenching plates 152 are parallel to the plane orthogonal to the third axis Z. The second arc quenching plates have an extension **152*l* in longitudinal direction of the metal plates and/or in direction of the X axis of substantially between about 20% and about 80%, in particular between about 25% and about 60%, of the length of the longitudinal edges 140, 340 of the metal plates 104, 108. Typically, the second arc quenching plates 152 have a first edge directed to the arc space which is disposed away from the bottom 146 of the V-shaped cut-out 144. For example, the distance d of the edge of the arc quenching plates 152 and the bottom 146 of the V-shaped cut-out may be about 10% of extension 152*l* of the second arc quenching plates 152 in direction of the longitudinal edge 140, 340 of the metal plates 104, 106. Typically, the distance d between the edge of the arc quenching plates in direction of the arc space is and the V-shaped or U-shaped cut-out permits a guiding of the arc in the arc displacement direction, such that the arc may reach the top of the arc-chute. In a typical embodiment, the second arc guides 152 are disposed substantially in the middle of the first straight slot 148, 348. Further, the second arc quenching plates 152 extend in arc displacement direction substantially all long the arc-chute. In a typical embodiment, the second arc quenching plates 152 may cover or have a length in arc displacement direction A substantially of at least 50%, in particular at least 80%, of the height of the stack in arc displacement direction A. Further, the second arc quenching plates 152** may have a thickness of about 1 mm to about 10 mm, for example 2 to 4 mm.

In an embodiment, the arc quenching plates 150, 152 are adapted to quench and guide the arc in the arc chute.

Typically, the first and second arc quenching plates 150, 152 may change the dielectric properties of the air between the metal plates. According to another theory, the arc quenching plates 150, 152 facilitate the entry of cool air into the arc-chute 100. According to a further theory, the arc quenching plates or guides direct the arcs into the arc-chute. In FIG. 1 the second arc quenching plates are shown with dashed lines.

In an example, the arc quenching plates 150, 152 support the quenching of the arc in the arc chute. For example, the arc quenching plates may be fabricated from a suitable polymer plate.

In a typical embodiment, the arc quenching plates may be selected from a suitable polymer plate selected of the group consisting of a flame retardant polymer, a flame retardant polymer comprising a flame retardant filler, and polymer comprising a flame retardant filler. In a typical embodiment, the flame retardant filler may be an inorganic flame retardant filler, such as e.g. aluminium hydroxide, magnesium hydroxide. In a typical embodiment, the suitable polymer plate may comprise as a base material polyester resins, for example unsaturated polyester resins.

In a typical embodiment, which may be combined with other embodiments disclosed herein, the arc quenching plates 150, 152 may be fabricated of sheet moulding compound or bulk moulding compounds. The suitable polymer plates may comprise a reinforcement structure, typically glass fibres. For example, the arc quenching plates may be fabricated of a duroplast, thermoset and/or thermoplast material being glass fibre reinforced.

In a typical embodiment, which may be combined with other embodiments disclosed herein, the suitable polymer plate may comprise 15 to 40 weight % glass fibres.

In typical embodiments, the material of the arc quenching plate, in particular the suitable polymer plate, includes fillers, for example 5 to 70 weight % fillers comprising typically the flame retardant filler. In an embodiment, the material of the arc quenching plates may contain aluminium trihydrate (ATH), for example 15 to 50 weight % ATH.

Figure 7:
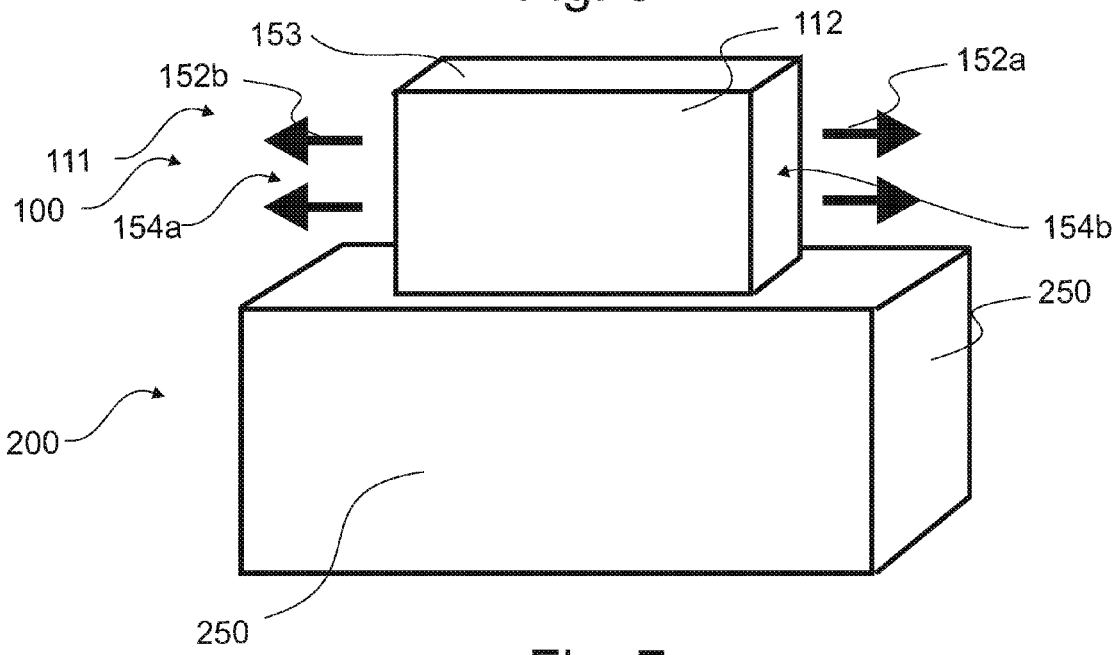
FIG. 7 shows schematically a perspective view of a circuit breaker according to an embodiment.

Typically, the arc chute is covered by a cover 153 shown in FIG. 7, which is fixed to the side walls 112. Hence, the number of pieces to assemble is substantially reduced.

Thus, the arc chute 100 is light and small due to the reduced clearance distance to a metallic wall of other components, for example if the circuit breaker is mounted on an electric vehicle, for example a train. Further, the metal plates of the arc chute have almost no wear. Further, there is substantially no risk of short circuits between the meal plates. Thus, it is easy to plan the maintenance of the circuit breaker, in particular of the arc chute. Further, the arc chute according to an embodiment can be quickly assembled and may be easily scalable, in particular as no plastic mould is needed. Further, the costs are reduced.

Typically, with the arc chute according to embodiments of the present disclosure the arc does not burn always at the same place, thus the ware is more evenly distributed about the metal plates 104*a*, 104*b*, . . . 104*n*, 108*a*, 108*b*, . . . 108*n*, such that the distance of the plates may be reduced and also the thickness of the plates can be reduced.

As shown in FIG. 6, the hot gases created during the disconnecting of the first switch contact and the second switch contact may substantially exhaust only in two directions 156*a*, 156*b*, in particular in parallel to the direction of the moving direction S of the second switch contact. Typically, the housing of the arc chute has openings 154*a*, 154*b* in direction of the moving direction S or an axis traversing the two stacks of the arc chute and the arc space 109. In a typical embodiment, the openings 154*a*, 154*b* have dimensions in the direction of the arc displacement direction A or stacking direction A of at least 90%, in particular 95%, of the first stack 102 or the second stack of metal plates. Further, the openings 154*a*, 154*b* have a dimension orthogonal to the arc displacement direction A and the moving direction S corresponding substantially to the dimension of the metal plates, for example at least 90%, in particular at least 95% of the width of the metal plates. Typically, the width of the metal plates is measured along a third axis orthogonal to the arc displacement direction A and orthogonal to the moving direction S.

The sidewalls 112 of the housing are typically in contact or adjacent to the metal plate of the first stack 102 and a second stack. For example the distance between the sidewalls 112 of the housing and the metal plates is less than 5 mm, in particular less than 2 mm. Hence, further equipment of the rolling stock on which such a circuit breaker may be disposed may be placed close to the circuit breaker, in contrast to circuit breakers in which the gas is exhausted to all sides of the metal plates 104, 108. Thus, the gas is only exhausted in a direction parallel to the moving direction S shown with arrows 156*a* and 156*b*.

FIG. 9 shows a perspective view of an embodiment of a circuit breaker including the arc chute 100 and the switch unit 200. As shown in FIG. 10, the arc chute 100 is covered from the side with the sidewalls 112 and on the top with a cover plate 153.

Thus, in a typical embodiment, the arc chute can be easily assembled, because the sidewalls 112 and the cover plate 153 are plate shaped and fabricated of plastic. Hence, the arc chute is variable, so that he can be easily adapted to the current or the voltage to be switched, for example the number of metal plates to be inserted into the arc chute can be easily adjusted by introducing more or less groups of metal plates 128. Further, the sidewalls 112 and the top wall or cover 153 may be easily adapted to the actual arc chute because they are plates which may be manufactured by sawing a bigger plate to the format used by the arc chute to be produced.

In a typical embodiment, which may be combined with other embodiments disclosed herein, the switch unit 200 is covered by switch unit sidewalls 250, which are manufactured from plastic plates. Thus, also the switch unit 200 may be easily manufactured.

Typically, for medium voltage DC breakers the total arcing time is much longer than for AC. Thus, higher temperatures are created and a plasma may be generated between the first switch contact and the second switch contact and in the arc chute.

The written description uses examples to disclose the invention, including the best mode, and also to enable any person skilled in the art to make and use the invention. While the invention has been described in terms of various specific embodiments, those skilled in the art will recognize that the invention can be practiced with modifications within the spirit and scope of the claims. Especially, mutually nonexclusive features of the embodiments described above may be combined with each other. The patentable scope of the invention is defined by the claims, and may include other examples that occur to those skilled in the art. Such other examples are to be within the scope of the claims.

LIST OF REFERENCE SIGNS

100 Arc chute
102 Stack
104, 104*a*, 104*b*, 104*n* Metal plate
106 Stack
108, 108*a*, 108*b*, 108*n* Metal plate
109 Arc space
110 Connection bar
111 Housing
112 Sidewall
128 Group of metal plates
130 Support device
130*d* Thickness
132 Cut out
132*d* Depth of cut out
134 Support cut out
134*h* Height
135 Bottom
140 Longitudinal edge
142 Transversal edge
144 V-shaped cut-out
146 Bottom
148 Slot
150 Arc guide
152 Arc guide
152*l* Longitudinal extension
153 Cover
154*a*, 154*b* Opening
156*a*, 156*b* Exhaust direction
200 Switch unit
202*a*, 202*b* Switch contact
203 Switch contact bar
204*a*, 204*b* Switch contact terminal
206 Drive unit
208*a* Flexible conductor
208*b* Contact bar
210*a*, 210*b* Horn
250 Side wall
304 Metal plate
340 Longitudinal edge
342 Transversal edge
344 V-shaped cut out
346 Bottom
348 Slot
350 Slot
d Distance
A Arc displacement direction, stacking direction
S Moving direction
X Second Axis
Y First Axis
Z Third Axis

The invention claimed is:

1. Arc chute for a medium voltage circuit breaker, comprising:

a housing;

two stacks of plural substantially parallel metal plates arranged in the housing, the two stacks defining a first axis in parallel to a stacking direction;

an arc space arranged in the housing for allowing an arc to expand therein; and at least two arc quenching plates respectively disposed in a corresponding one of the stacks in the housing, the arc quenching plates having at least one surface with a surface plane extending parallel to the first axis, wherein a second axis traverses in parallel to the metal plates of the two stacks and the arc space is substantially orthogonal to the first axis, wherein the surface plane of the at least one surface of the arc quenching plates extends parallel to the second axis, and wherein one of the arc quenching plates is respectively arranged at each sidewall of the housing in the arc space between the metal plates of a first one of the stacks and a second one of the stacks.

2. Arc chute according to claim 1, wherein:

at least one of the arc quenching plates has an extension in a direction of the first axis of at least 50% of an extension of at least one of the stacks of metal plates in the direction of the first axis.

3. Arc chute according to claim 1, wherein:

at least one of the arc quenching plates has an extension in a direction of the second axis of between about 20% and about 80% of the extension of the metal plates in a direction of the second axis.

4. Arc chute according to claim 1, wherein:

the metal plates of the stacks have two longitudinal edges extending in parallel to the second axis, and wherein at least one of the arc quenching plates is arranged between the two longitudinal edges.

5. Arc chute according to claim 1, wherein:

the metal plates are substantially rectangular having two transversal edges parallel to a third axis which is orthogonal to the first axis and the second axis, and two longitudinal edges parallel to the second axis; wherein:

the metal plates have respectively a substantially V-shaped or U-shaped cut-out in a first of the two transversal edges which is adjacent to the arc space; and at least one of the two arc quenching plates is disposed between the V-shaped or U-shaped cut-out and a second of the two transversal edges.

6. Arc chute according to claim 1, wherein:

the metal plates of the stacks are substantially rectangular and have two longitudinal edges and two transversal edges; wherein:

the metal plates comprise a slot which extends substantially parallel to the longitudinal edges and has a longitudinal extension of at least 20% of a length of the longitudinal edges; and wherein:

one of the arc quenching plates is disposed in the slot.

7. Arc chute according to claim 6, wherein:

the slot is arranged substantially in a middle between the two longitudinal edges.

8. Arc chute according to claim 6, wherein:

the slot extends from a substantially V-shaped or U-shaped cut-out in the transversal edges, wherein the cut-out has an extension in longitudinal direction of at least 10% of a length of the longitudinal edges.

9. Arc chute according to claim 6, wherein:

the arc quenching plates are disposed such that an edge of the arc quenching plates directed to the arc space has a distance to an end of the slot in a direction of the arc space and/or to an end of the V-shaped or U-shaped cut-out towards a second of the transversal edges of at least about 10% of an extension of the arc quenching plate in a direction of the second axis.

10. Arc chute according to claim 1, wherein:

the arc quenching plates delimit the arc space in a direction orthogonal to the first axis and orthogonal to the second axis.

11. Arc chute according to claim 10, wherein:

the arc quenching plates delimiting the arc space act as a stop for the metal plates of the stacks, such that a movement of the metal plates into the arc space is prevented.

12. Arc chute according to claim 1, in combination with a circuit breaker comprising:

a switching unit, having a first switch contact and a second switch contact, movable between a first position wherein the first switch contact contacts the second switch contact, and a second position, wherein the first switch contact is separated from the second switch contact.

13. Arc chute according to claim 1, wherein at least one of the arc quenching plates is a polymer plate selected from the group consisting of: a flame retardant polymer, a flame retardant polymer comprising a flame retardant filler, and a polymer comprising a flame retardant filler.

14. Arc chute according to claim 2, wherein the extension of the at least one arc quenching plate is at least 80%.

15. Arc chute according to claim 3, wherein the extension of the at least one arc quenching plate in the direction of the second axis is between about 25% and about 60%.

16. Arc chute according to claim 4, wherein the arc quenching plates are substantially in a middle between the two longitudinal edges.

17. Arc chute according to claim 6, wherein the slot has a longitudinal extension of at least ⅓ of the length of the longitudinal edges.

18. Arc chute according to claim 10, wherein the two arc quenching plates delimit the arc space.

* * * * *